US007867960B2

(12) United States Patent
Yamaguchi et al.

(10) Patent No.: US 7,867,960 B2
(45) Date of Patent: Jan. 11, 2011

(54) METHOD FOR FORMING TETRAOXY-SILANE DERIVED ANTIWEAR FILMS AND LUBRICATING OIL COMPOSITIONS THEREFROM

(75) Inventors: Elaine S. Yamaguchi, El Cerrito, CA (US); Kam-Sik Ng, San Lorenzo, CA (US)

(73) Assignee: Cherron Oronite Company LLC, San Ramon, CA (US)

( * ) Notice: Subject to any disclaimer, the term of this patent is extended or adjusted under 35 U.S.C. 154(b) by 1118 days.

(21) Appl. No.: 11/515,208

(22) Filed: Aug. 31, 2006

(65) Prior Publication Data

US 2008/0058231 A1 Mar. 6, 2008

(51) Int. Cl.
*A61K 9/00* (2006.01)
*B01D 19/04* (2006.01)
*C10M 163/00* (2006.01)

(52) U.S. Cl. ..... 508/564; 508/202; 508/173

(58) Field of Classification Search ..... 508/364, 508/202, 173, 136
See application file for complete search history.

(56) References Cited

U.S. PATENT DOCUMENTS

| | | | | |
|---|---|---|---|---|
| 2,416,504 | A | 2/1947 | Trautman et al. | |
| 2,730,532 | A | 1/1956 | Martin | |
| 2,881,198 | A | 4/1959 | Bailey et al. | |
| 2,960,474 | A * | 11/1960 | Furby et al. | 252/78.3 |
| 3,098,825 | A | 7/1963 | Shiftier | |
| 3,637,416 | A | 1/1972 | Misch et al. | |
| 4,051,053 | A | 9/1977 | Elliott et al. | |
| 4,541,838 | A | 9/1985 | Zaweski et al. | |
| 4,691,039 | A | 9/1987 | Aasen et al. | |
| 5,534,173 | A | 7/1996 | Faber et al. | |
| 5,625,004 | A * | 4/1997 | Harrison et al. | 525/285 |
| 5,670,257 | A | 9/1997 | Sakai et al. | |
| 5,817,853 | A | 10/1998 | Friedrich et al. | |
| 6,140,445 | A * | 10/2000 | Su et al. | 528/15 |
| 6,166,237 | A | 12/2000 | Simandan et al. | |
| 6,454,969 | B1 | 9/2002 | Nishihara | |
| 6,593,433 | B2 | 7/2003 | Agostini | |
| 6,884,314 | B2 | 4/2005 | Cross et al. | |
| 6,887,835 | B1 * | 5/2005 | Migdal et al. | 508/204 |
| 6,955,728 | B1 | 10/2005 | van Ooij et al. | |
| 2005/0176594 | A1 | 8/2005 | Grabowski et al. | |

FOREIGN PATENT DOCUMENTS

| | | |
|---|---|---|
| CN | 1683479 | 10/2005 |
| GB | 0 760 097 | 10/1956 |
| GB | 1 229 892 | 4/1971 |
| GB | 1 441 335 | 6/1976 |
| JP | 200226881 | 8/2002 |
| JP | 2004-231560 | 8/2004 |

OTHER PUBLICATIONS

Arkles, B., (Gelest Inc.), Tailoring Surfaces with Silanes, Chemtech, (1977), pp. 766-776, vol. 7.

Chen et al., Kinetics of Formation of Monodisperse Colloidal Silica Particles through the Hydrolysis and Condensation of Tetraethylorthosilicate, Ind. Eng. Chem. Res., (1996), pp. 4487-4493, vol. 35, No. 12, American Chemical Society.

Cihlar, J., Hydrolysis and Polycondensation of Ethyl Silicates. 1. Effect of pH and Catalyst on the Hydrolysis and Polycondensation of Tetraethoxysilane (TEOS), Colloids and Surfaces A: Physicochemical and Engineering Aspects, (1993), pp. 239-251, vol. 70, Elsevier Science Publishers B.V., Amsterdam.

Clausen et al., The First Tri- and Tetraalkoxysilanes with Four Different Substituents, J. Org. Chem., (1997), pp. 4457-4464, vol. 62, No. 13, American Chemical Society.

Emblem et al., Preparation and Properties of Some Aminoalkoxysilanes, J. Appl. Chem., (Jan. 1962), pp. 5-9, vol. 12.

Emblem et al., The Preparation of Alkoxysilanes from Glycols and Glycol Monoethers, J. Inorg. Nucl. Chem., (1968), pp. 721-727, vol. 30, Pergamon Press Ltd., Great Britain.

Husing at al., Formation and Structure of Porous Gel Networks from $Si(OMe)_4$ in the Presence of $A(CH_2)_nSi(OR)_3$ (A=Functional Group), Chem. Mater., (1998), pp. 3024-3032, vol. 10, No. 10, American Chemical Society.

Husing et al., Formation and Structure of Gel Networks from $Si(OEt)_4/(MeO)_3Si(CH_2)_3NR'_2$ Mixtures ($NR'_2$ =$NH_2$ or $NHCH_2CH_2NH_2$), Chem. Mater., (1999), pp. 451-457, vol. 11, No. 2, American Chemical Society.

Mehrotra et al., Aminoalkoxysilanes I. Amino Derivatives of Alkoxy- and Alkylalkoxysilanes, J. Organometal Chem., (1970), pp. 611-621, vol. 24, Elsevier Sequoia S.A., Lausanne.

Gelest, Inc., Silicon-Based Synthetic Reagents: Tetrasubstituted Organosilanes, (2005), pp. 1-8, (http://ww.oelest.com/company/pdfs/syntheticreagentsprotectedorganicmolecules.pdf last visited Feb. 8, 2007).

* cited by examiner

*Primary Examiner*—Walter D Griffin
*Assistant Examiner*—Frank C Campanell
(74) *Attorney, Agent, or Firm*—Claude J. Caroli; M. Carmen & Associates PLLC

(57) ABSTRACT

Disclosed is a method for forming an antiwear film on an internal engine component comprising: contacting a surface of an internal wearing component of the engine with a tetra-functional hydrolyzable silane compound of the general formula Si—$X_4$ or hydrolysis product thereof, wherein X is independently selected from the group consisting of hydroxyl, alkoxy, aryloxy, acyloxy, amino, monoalkyl amino and dialkyl amino; and hydrolyzing and condensing the tetra-functional silane to thereby form a film. Also disclosed are mixed silane films and the products produced by these methods.

23 Claims, No Drawings

METHOD FOR FORMING TETRAOXY-SILANE DERIVED ANTIWEAR FILMS AND LUBRICATING OIL COMPOSITIONS THEREFROM

FIELD OF THE INVENTION

The present invention is directed to methods for forming antiwear films from tetra-functional hydrolyzable silane compositions, products containing hydrolyzed and/or condensed tetraoxy-silane compounds and to use in lubricating oil compositions and to the formation of protective films, i.e. antiwear films in components to be lubricated therefrom. More particularly, it is directed to a class of non-phosphorus and non-sulfur containing additives suitable for use as antiwear agents, antifatigue agents, and extreme pressure agents and discloses methods for using these agents in lubricating oil compositions.

BACKGROUND OF THE INVENTION

Phosphorus, particularly the phosphorus delivered by zinc dialkyldithiophosphate (ZDDP), has been the predominant antiwear agent in fully formulated lubricants for the past 50 years. Studies have suggested that phosphorus may poison catalytic converters used on gasoline-fueled engines to reduce exhaust emissions of unburned hydrocarbons and oxides of nitrogen [Spearot, J. A., and Caracciolo, F. (1977), "Engine Oil Phosphorus Effects on Catalytic Converter Performance in Federal Durability and High Speed Vehicle Tests," SAE Technical Paper 770637; Caracciolo, F., and Spearot, J. A. (1979), "Engine Oil Additive Effects on the Deterioration of a Stoichiometric Emissions Control (C-4) System," SAE Technical Paper 790941; Ueda, F., Sugiyama, S., Arimura, K., Hamaguchi, S., and Akiyama, K. (1994), "Engine Oil Additive Effects on Deactivation of Monolithic Three-Way Catalysts and Oxygen Sensors," SAE Technical Paper 940746]. As the environmental regulations governing tailpipe emissions have tightened, the allowable concentration of phosphorus in engine oils has been significantly reduced. Further reductions in the phosphorus content of engine oil are likely in the next category, GF-5, to perhaps 0.05 wt. %.

Many partial solutions exist, where either Zn, P, or S have been partially or totally eliminated. In one approach Zhang et al. [Zhang, Z., Yamaguchi, E. S., Kasrai, M., Bancroft, G. M., "Tribofilms Generated From ZDDP and ashless dialkyldithiophosphate (DDP) on Steel Surfaces, Part 1, Growth, Wear, and Morphological Aspects," Tribology Letters, Vol. 19, 3, pp 211-220 (2005)] studied the growth and morphology of tribofilms, generated from ZDDP and a DDP over a wide range of rubbing times (10 seconds to 10 hours) and concentrations (0.1-5 wt. % ZDDP), using atomic force microscopy (AFM), X-ray photoelectron spectroscopy (XPS), and X-ray absorption near edge structure (XANES) spectroscopy at the O, P, and S K-edges and the P, S, and Fe L-edges. The major components of all films, generated using a Cameron-Plint tester, on 52100 steel are Zn and Fe phosphates and polyphosphates. The average thickness of these phosphate films has been measured using P K-edge XANES and XPS profiling. For ZDDP, a very significant phosphate film (about 100 Å thick) forms after 10 seconds, while film development for DDP is substantially slower. However, for both additives, the average film thickness increases to 600-800 Å after 30 minutes of rubbing, before leveling off or decreasing.

The antiwear properties of pure ZDDP and in combination with DDP at different rubbing times and concentrations were also been examined. It was found that under all conditions, the performance of ZDDP as an antiwear agent is superior to that of DDP. However, DDP has no adverse effect on the performance of ZDDP when the two are mixed, suggesting that DDP can be used with ZDDP, thereby reducing the amount of total ash.

Another approach that reduces ash was developed by Manka in U.S. Pat. No. 5,674,820 relates to a composition, comprising: (A) a compound represented by the formula:

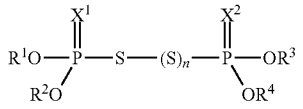

wherein $R^1$, $R^2$, $R^3$, and $R^4$ are independently hydrocarbyl groups, and $X^1$ and $X^2$ are independently O or S, and n is 0 to 3; and (B) an acylated nitrogen-containing compound have a substituent of at least 10 aliphatic carbon atoms. In one embodiment, the inventive composition further comprises (C) a second phosphorus compound other than (A), said second phosphorus compound being a phosphorus acid, phosphorus acid ester, phosphorus acid salt, or derivative thereof. In one embodiment, the inventive composition further comprises (D) an alkali or alkaline earth metal salt of an organic sulfur acid, carboxylic acid, or phenol. In one embodiment, the inventive composition further comprises (E) a thiocarbamate. These compositions are useful in providing lubricating compositions and functional fluids with enhanced antiwear properties. Specifically, the compositions disclosed are useful as tractor hydraulic fluids, which show enhanced antiwear and antiscore performance.

In U.S. Pat. No. 5,405,545, antiwear and antioxidant properties are claimed for this invention. A lubricant additive having antiwear and antioxidant properties is the reaction product of a thiodicarboxylic acid and an ether amine, preferably 3,3'-thiodipropionic acid and N-isoeicosyloxypropyl-1,3-diaminopropane which is post-reacted with an aliphatic alcohol, preferably oleyl alcohol, an aliphatic amine, preferably a tert-$C_{12}$ to $C_{14}$ amine and/or a trialkylphosphite, preferably a tributylphosphite. The post-reaction product contains at least one ester, amide, and/or phosphonate functional group. Data from a Four-Ball test were given in support of the beneficial antiwear performance.

A supplemental wear inhibitor that contains no phosphorus is described in U.S. Publication No. 2003/0148899 A1. This disclosure provides a lubricant oil composition, having enhanced wear-preventive characteristics for a diesel engine operating with large quantities of soot in the oil (soot content: 0.20-4.0 wt. %), and is especially suitable for a pressure-accumulating (common rail) type diesel engine equipped with an exhaust gas recirculation (EGR) system. The claimed lubricant oil composition contains a base oil composed of a mineral and/or synthetic oil incorporated with at least three additives that are a sulfurized oxymolybdenum dithiocarbamate at 0.03 to 0.50 wt. % as Mo; a zinc dialkyldithiophosphate at 0.04 to 0.05 wt. % as P; and at least one metallic salt of alkyl salicylate selected from the group consisting of a Ca salt of alkyl salicylate at 0.004 to 1.0 wt. % as Ca, Mg salt of alkyl salicylate at 0.002 to 0.60 wt. % as Mg, and Zn salt of alkyl salicylate at 0.006 to 1.60 wt. % as Zn, all percentages being based on the whole composition. Bench tests in SRV friction/wear tester were conducted.

The above references largely describe P- or S-containing supplemental wear inhibitors. Unfortunately the tightening of emission requirements requires wear inhibitors with no P, S, and Zn. Trialkylsilanes were disclosed to add thermal stability to lubricants in U.S. Pat. No. 4,572,791 and phenyltrialkylsilanes were disclosed for oxidation improvement in U.S. Pat. No. 5,120,485. Trifunctional hydrolyzable silanes have found some applications in fuels and lubricant compositions; U.S. Pat. No. 4,541,838 discloses additive mixtures of an organic nitrate ignition accelerator and a trialkoxysilane for use in fuel compositions. U.S. Pat. No. 6,887,835 discloses bis-(trialkoxysilyl)alkyl polysulfides as well as other linking groups including polysiloxanes. The bis and polymeric silane compounds showed a reduction in the Falex 4-ball wear scar using the ASTM D 4172 test.

Russian Patent No. SU-245955 (Jun. 11, 1969) discloses lubricant additives which improve the antifriction and anticorrosion characteristics of lubricating oils when used in amounts of 2-35% weight, preferably 5% wt are trialkoxyorganosilanes of the general formula $(AlkO)_3SiRR'$ (where AlkO is an alkoxy group, R is alkyl, aryl or alkenyl group, and R' is a functional group such as such as $NH_2$, $CO_2H$, COH, OH, or CN).

Great Britain Patent No. 1 441 335 discloses lubricant compositions to improve antifatigue containing about 0.01 to 5% weight of a condensation polymer derived from a trialkoxysilane of the formula $R—Si(OR^1)_3$ where R is $C_{1-24}$ alkyl or $C_{2-24}$ alkoxyalkyl, and $R^1$ is $C_{1-12}$ alkyl or $C_{2-12}$ alkoxyalkyl, where alkoxyalkyl means an ether group represented by $—C_n—O—C_m—$ wherein the sum of n plus m is 2 to 24 in the case of R and 2 to 12 in the case of $R^1$.

Japanese Patent Publication No. 8-337788 (Dec. 24, 1996) discloses additives consisting of silane compounds, e.g., a): $R_1Si(OR)_3$, b): $(R_1)_2Si(OR)_2$, and c): $(R_1)_3SiOR$ where (R=H, $C_{1-18}$ alkyl, $C_{2-18}$ alkenyl, $C_{6-18}$ aryl; and $R_1$=$C_{6-50}$ alkenyl optionally containing a N, O, and/or S atom or substituted with hydroxyl, carbonyl, alkoxycarbonyl, alkenoxycarbonyl or aryloxycarbonyl, or a $C_{6-50}$ aryl. Also claimed are (i) lubricating oil compositions containing for engines comprising 0.05-10 wt. % the additive(s); (ii) compositions containing: (A) the additive(s); (B) a metal cleaner(s) in a base oil; (C) an extreme pressure lubricant(s); and (D) an ash-free dispersant(s). The additives are said to improve cleanliness of the piston of engines and thereby allow a reduction of amount of phosphorus-type extreme pressure agents and ester-type oiliness improvers added and prolong the lifetime of engine oils. The compositions are also said to have high friction reducing effects.

SUMMARY OF THE INVENTION

This invention relates to a method for forming an antiwear film onto a wear component, that is a component which is subject to wear. This antiwear film can be formed on internal engine components which are subject to wear, either prior to assembly or formed in-situ for example when a tetra-functional hydrolyzable silane compound is presented in a lubricating oil medium. Accordingly, disclosed is a method for forming an antiwear film on an internal engine component comprising: contacting a surface of an internal wearing component of the engine with a tetra-functional hydrolyzable silane compound of the general formula $Si—X_4$ or hydrolysis product thereof, wherein each X is independently selected from the group consisting of hydroxyl, alkoxy, aryloxy, acyloxy, amino, monoalkyl amino and dialkyl amino; and hydrolyzing and condensing the tetra-functional silane to thereby form a film. The hydrolysis and condensing step can be affected by heating (for example from about 20 to 300° C.), by operating an engine to provide a rubbing under load on at least one contacting surface, or by the addition of a suitable catalyst, etc.

One aspect is directed to wherein the tetra-functional hydrolyzable silane compound is in a lubricating oil medium and thus, the contacting is performed by via the lubricating oil. The lubricating oil may be formulated with other additives such as dispersant, detergents, antioxidants etc. which can affect the hydrolyzing and condensing and/o maybe incorporated into the wear film. Other conventional additives found in motor oils could be added and serve this purpose. Additionally the hydrolyzing and condensing step can be conducted in the presence of a catalyst. The catalyst may be formed as a contaminant and for example, may be introduced by operating the engine and thus may be water, acid gases or metal wear particles produced by the combustion process.

A particularly preferred tetra-functional hydrolyzable silane compound is selected from the compound of the formula I or a hydrolysis product thereof:

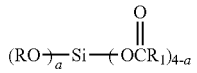

(I)

wherein each R is independently a $C_{1-20}$ hydrocarbyl group selected from the group consisting of straight and branched chain alkyl, cycloalkyl, alkcycloalkyl, aryl, alkaryl, arylalkyl and substituted hydrocarbyl groups having one or more substituents selected from hydroxy, alkoxy, ester or amino groups; each $R_1$ is independently straight and branched chain alkyl, cycloalkyl and aryl; and a is an integer of 0 to 4. The acyloxy-substituted silane compounds typically are more susceptible to hydrolysis than the alkoxy substituted silane compounds thus preferably a, is an integer from 1 to 4, and more preferably is 4; with tetraalkoxysilane being particularly preferred.

The method for forming the wear film can employ a mixture of the tetra-functional hydrolyzable silane compounds or a single compound. Additionally, this method may comprise further contacting a surface of an internal wearing component of the engine with a partially non-hydrolyzable silane additives are represented by the formula II $$(R_{10})_nSi(OR_{11})_{4-n} \quad (II)$$

wherein each $OR_{11}$ group is a hydrolyzable moiety independently selected from the group consisting of alkoxy, aryloxy, and acyloxy, each $R_{10}$ is a non-hydrolyzable group independently selected from alkyl, aryl, substituted alkyl, and substituted aryl, wherein the substituent is a functional group selected from hydroxyl, ether, amino, monoalkylamino, dialkylamino, amide, carboxyl, mercapto, thioether, acryloxy, cyano, aldehyde, alkylcarbonyl, sulfonic acid and phosphoric acid; and n is an integer of 1, 2 or 3.

This further contacting may be conducted prior to contacting with the tetra-functional hydrolyzable silane compound of the formula Si—X4, concurrent or subsequent with the contacting with the tetra-functional hydrolyzable silane compound. Unique wear films can be formed by this combination of tetra-functional hydrolyzable silane compounds and a partially non-hydrolyzable silane component represented by the formula II.

The products prepared according to the methods of the present invention form an antiwear film which may serve as a replacement for current antiwear agents, e.g. ZDDP. Accordingly, as aspect of the present invention is directed to a product prepared according to the method for forming a wear film on an internal engine component comprising: contacting a surface of an internal wearing component of the engine with a tetra-functional hydrolyzable silane compound of the general formula Si—$X_4$ or hydrolysis product thereof, wherein each X is independently selected from the group consisting of hydroxyl, alkoxy, aryloxy, acyloxy, amino, monoalkyl amino and dialkyl amino; and hydrolyzing and condensing the tetra-functional silane to thereby form a film. The tetra-functional hydrolyzable silane compound can be employed in a lubricating oil medium which may contain other additives which may be incorporated or affect the film formation. Thus an aspect is directed to the products prepared thereby.

A particularly preferred product is prepared by the process of:

preparing a lubricant composition comprising:

a) a major amount of a base oil of lubricating viscosity;

b) 0.5 to 10% of a tetra-functional hydrolyzable silane compound is selected from the compound of the formula I or a hydrolysis product thereof:

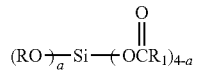

(I)

wherein

R is independently a $C_{1-20}$ hydrocarbyl group selected from the group consisting of straight and branched chain alkyl, cycloalkyl, alkcycloalkyl, aryl, alkaryl, arylalkyl and substituted hydrocarbyl groups having one or more substituents selected from hydroxy, alkoxy, ester or amino groups;

$R_1$ is independently straight and branched chain alkyl, cycloalkyl and aryl; and a is an integer of 0 to 4;

c) 0.5 to 10% of a detergent; and d) 1 to 20% of an alkenyl succinimide dispersant derived from a 450 to 3000 average molecular weight polyalkylene;

wherein the percent additive is based upon the total weight percent of the lubricating composition; and operating an internal combustion engine using said lubricant to lubricate an internal wear component surface of the engine. The product prepared by this process may include a heating step to heat the lubricant to a temperature of about 20 to 300° C., more preferably greater than about 100° C.

DETAILED DESCRIPTION

Silicon esters are organic silicon compounds that contain an oxygen bridge from the silicon atom to the organic group, i.e. ≡Si—O—$R_i$. The earliest reported organic silicon compounds containing four oxygen bridges were derivatives of orthosilicic acid, $Si(OH)_4$. Silicic acid behaves as though it is dibasic with pKs at about 9.8 and 11.8 and can form polymers such as silica gels and silicates by condensation of the silanol groups or reaction of silicate ions. Commonly organic silicon compounds are referred to by their organic nomenclature, for example the alkoxy derivatives $Si(OC_2H_5)_4$ is tetraethoxysilane and the acyloxy derivatives $Si(OOCCH_3)_4$ is tetraacetooxysilane.

The esters of orthosilicic acid and their lower condensation stages are not regarded as organosilanes in the strictest sense; since unlike organo(organoxy)silanes, tetra(hydrocarbyloxy) silanes can be synthesized directly from silicon or suitable natural silicates and alcohols. Tetra(hydrocarbyloxy)silanes have a wide variety of applications which are somewhat dependent on whether the Si—O—$R_i$ bond is expected to remain intact or to be hydrolyzed in the final application.

Tetra(hydrocarbyloxy)silanes may contain up to four matrix coordinations in the polymeric hydrolysates and thus can lead to more rigid films than alkyl and aryltrialkoxysilanes which have three matrix coordinations. Likewise, monoalkoxysilane can only form a monolayer or partial monolayer. The film could be a monolayer of multilayer. The multilayer could be either interconnected through a loose network structure, intermixed, or both and are in fact formed by most deposition techniques. These films can also contain other surface active components, such as detergents, antiwear agents, dispersants, etc. which can lead to unique protective films. The formation of covalent bonds to the surface proceeds with a certain amount of reversibility with the degree of hydrogen bonding decreasing with further condensation. Likewise with the removal of water the bonds may form, break and reform to relieve internal stress of the film and likewise can permit a positional displacement of interface components. Hydrolysis on adsorption onto a metal surface has been observed at room temperature for carboxylic acid esters and certain phosphate esters. Thus, the surface may be reactive. However, both adsorption onto a metal surface and rubbing under load are typically needed to produce the mature antiwear film in the case of the esters of orthosilicic acid. The films thus produced have been found to contain Si and are effective in preventing wear, as seen in the examples below.

The Si—O—$R_i$ bond undergoes a variety of reactions apart from the hydrolysis and condensation. The alkoxy moiety can improve oil solubility and stability with increased steric bulk, increased size of the alkoxy groups can decrease the rate of hydrolysis. Tertra(alkoxy)silanes and tetra(aryloxy)silanes possess excellent thermal stability and liquid behavior over a broad temperature range what widens with length and branching of the substituents. Acyloxy- and amino-substituted silanes are typically more susceptible to hydrolysis than the alkoxysilanes. The increased rate can be attributed to the acidic or basic character of the byproducts. Thus catalytic amounts of amine or acid are often added to accelerate this rate. Table A illustrates some physical properties of commercially available silane esters.

TABLE A

PHYSICAL PROPERTIES OF SILANE ESTERS[a]

| Compound | CAS Registry | Formula | Boiling Point[b] ° C. | Melting Point ° C. | Density g/cm3 | Flash-Point |
|---|---|---|---|---|---|---|
| Tetramethoxysilane | [681-84-5] | $Si(OCH_3)_4$ | 121 | 2 | 1.032 | 20 |
| Tetraethoxysilane | [78-10-4] | $Si(OC_2H_5)_4$ | 169 | −85 | 0.934 | 46 |
| Tetrapropoxysilane | [682-01-9] | $Si(O\text{-}n\text{-}C_3H_7)_4$ | 224 | <−80 | 0.916 | 95 |

TABLE A-continued

PHYSICAL PROPERTIES OF SILANE ESTERS[a]

| Compound | CAS Registry | Formula | Boiling Point[b] ° C. | Melting Point ° C. | Density g/cm3 | Flash-Point |
|---|---|---|---|---|---|---|
| Tetraisopropoxysilane | [1992-48-9] | $Si(O\text{-}i\text{-}C_3H_7)_4$ | 185 | <−22 | 0.887 | 60 |
| Tetrabutoxysilane | [4766-57-8] | $Si(O\text{-}n\text{-}C_4H_9)_4$ | $115_{0.4}$ | <−80 | 0.899 | 110 |
| Tetrakis(s-butoxy)silane | [5089-76-9] | $Si(O\text{-}sec\text{-}C_4H_9)_4$ | $87_{0.27}$ | | 0.885 | 104 |
| Tetrakis(2-ethyl-butoxy)silane | [78-13-7] | $Si(OCH_2CH(C_2H_5)_2)_4$ | $166_{0.27}$ | <−70 | 0.892 | 116 |
| Tetrakis(2-ethyl-hexoxy)silane | [115-82-2] | $Si(OCH_2CH(C_2H_5)(C_4H_9)))_4$ | $194_{0.13}$ | <−80 | 0.88 | 188 |
| Tetrakis(2-methoxy-ethoxy)silane | [2157-45-1] | $Si(OCH_2CH_2OCH_3)_4$ | $179_{14.7}$ | <−70 | 1.079 | 140 |
| Tetraphenoxysilane | [1174-72-7] | $Si(OC_6H_5)_4$ | $236_{0.13}$ | 48 | 1.141 | |
| Tetracetoxysilane | [5623-90-2] | $Si(OOCCH_3)_4$ | $148_{0.8}$ | 110 sub | 1.06 | |
| Tetrakis(2-hydroxyethyl)silane | [17622-94-5] | $Si(OCH_2CH_2OH)_4$ | 200 | | 1.196 | |
| Diacetoxy-diisopropoxysilane[c] | [13170-15-5] | $(CH_3COO)_2Si(OCH(CH_3)_2)_2$ | | | | |
| Diacetoxy-di-tert-butoxysilane[c] | [13170-23-5] | $(CH_3COO)_2Si(OC(CH_3)_3)_2$ | | | | |

[a]Kirk-Othmer Encyclopedia of Chemical Technology Vol 22, John Wiley & Sons, Inc.
[b]Subscript denotes pressure, other than atmospheric, in kPa. To convert kPa to psi, multiply by 0.145
[c]Available from Sigma Aldrich Co.

The silicon ester compounds of the present invention may be prepared by a wide number of synthetic pathways. The oldest principal method of silicon ester production was described by Von Ebelman's 1846 synthesis:

$$SiCl_4+4C_2H_5OH \rightarrow Si(OC_2H_5)_4+4HCl$$

Catalyzed direct reactions of alcohols using silicon metal introduced in the 1940s and 1950s (see U.S. Pat. Nos. 2,473,260 and 3,072,700) became important commercial technology in the 1990s for production of the lower esters via use of a metal alcoholate catalysis, U.S. Pat. No. 4,113,761. Another commercial method used to prepare alkoxysilanes is by transesterification. Transesterification is practical when the alcohol to be esterified has a high boiling point and the leaving alcohol can be removed by distillation. Other preparative methods of alkoxysilanes can be exemplified as follows:

1. $\equiv SiCl+(RO)_3CH \rightarrow \equiv SiOR+RCl+ROOCH$
2. $\equiv SiCl+NaOR \rightarrow \equiv SiOR+NaCl$
3. $\equiv SiH+HOR\ (catalyst) \rightarrow \equiv SiOR+H_2$
4. $\equiv SiOH+HOR \rightarrow \equiv SiOR+H_2O$
5. $\equiv SiCl+CH_3NO_2 \rightarrow \equiv SiOCH_3+NO_2Cl$
6. $\equiv SiSR+HOR \rightarrow \equiv SiOR+H_2S$
7. $\equiv SiCl+HOC(O)R \rightarrow \equiv SiOC(O)R+HCl$
8. $\equiv SiCl+HONR'R'' \rightarrow \equiv SiONR'R''+HCl$ Acyloxysilanes are readily produced by the reaction of an anhydride and a chlorosilane. Aminosilanes are formed by the reaction of hydroxylamines with chlorosilanes and removal of liberated hydrogen chloride by base. Processes for preparing acyloxysilanes and alkoxy-acyloxy-silanes, particularly di-tert-butoxydiacetoxysilanes, are disclosed in U.S. Pat. Nos. 3,296,195; 3,296,161; 5,817,853 and European Patent Application Publication No. 0 465 723.

Tetraalkoxysilanes typically are prepared in slurry-phase Direct Synthesis processes wherein the solvent is often the product itself. The catalyst can be copper or a copper compound, but is usually an alkali or alkali metal salt of a high boiling alcohol. Such processes are disclosed in U.S. Pat. Nos. 3,627,807; 3,803,197; 4,113,761; 4,288,604 and 4,323,690. Likewise for trialkoxysilanes, the Direct Synthesis process employs catalytically-activated silicon particles maintained in suspension in an inert, high boiling solvent and are made to react with an alcohol at an elevated temperature. This type of reaction is disclosed in U.S. Pat. Nos. 3,641,077; 3,775,457; 4,727,173; 4,761,492; 4,762,939; 4,999,446; 5,084,590; 5,103,034; 5,362,897; 5,527,937. Slurry-phase reactors for the Direct Synthesis of alkoxysilanes and tetraalkoxysilanes may be operated in a batchwise or continuous mode. In batchwise operation, a single addition of silicon and catalyst is made to the reactor at the outset and alcohol is added continuously, or intermittently, until the silicon is fully reacted, or reacted to a desired degree of conversion. The alcohol typically is added in the gas phase but liquid phase addition is also feasible. In continuous operation, silicon and catalyst are added to the reactor initially and thereafter to maintain the solids content of the slurry within desired limits. The batchwise mode is illustrated in U.S. Pat. Nos. 4,727,173, 5,783,720, and 5,728,858. The desired reaction products are removed from the reactor in a gas phase mixture along with unreacted alcohol. Isolation of the product is accomplished readily by distillation according to known procedures. Continuous Direct Synthesis of trialkoxysilanes is disclosed in U.S. Pat. No. 5,084,590 and of tetraalkoxysilanes in U.S. Pat. Nos. 3,627,807; 3,803,197 and 4,752,647.

The hydrolyzable tetrafunctional silanes useful in the formulation of the lubricating oil compositions and in the film coating compositions of the present invention have four functional groups attached to the silicon atom. Theses tetra-functional hydrolyzable silane compounds are of the general formula $Si—X_4$ or hydrolysis product thereof, wherein X is independently selected from the group consisting of hydroxyl, alkoxy, aryloxy, acyloxy, amino, monoalkyl amino and dialkyl amino. More particularly X is independently selected for the group consisting of $C_{1-6}$ alkoxy, $C_{6-10}$ and aryloxy, $C_{1-6}$ acyloxy. The hydrolyzable groups employed may be hydrolyzed by water, undergo alcholysis, transesterifcations reactions, and/or produce polysiloxanes derivatives by condensation. The tetracoordination of these silane compounds provide for three dimensional film formation with the simultaneous properties of having great hardness and high mechanical resilience.

The term "hydrolyzable group" in connection with the present invention refers to a group which either is directly capable of undergoing condensation reactions under appropriate conditions or which is capable of hydrolyzing under appropriate conditions, thereby yielding a compound, which is capable of undergoing condensation reactions. Appropriate conditions include acidic or basic aqueous conditions, optionally in the presence of a condensation catalyst. Accordingly, the term "non-hydrolyzable group" as used in the present invention refers to a group not capable of either directly undergoing condensation reactions under appropriate conditions or of hydrolyzing under the conditions listed above for hydrolyzing the hydrolyzable groups.

More particularly preferred are the tetra-functional hydrolyzable silane compounds selected from the compound of the formula I or a hydrolysis product thereof:

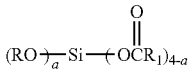

(I)

wherein

R is independently a $C_{1-20}$ hydrocarbyl group selected from the group consisting of straight and branched chain alkyl, cycloalkyl, alkcycloalkyl, aryl, alkaryl, arylalkyl and substituted hydrocarbyl groups having one or more substituents selected from hydroxy, alkoxy, ester or amino groups; $R_1$ is independently straight and branched chain alkyl, cycloalkyl and aryl; and a is an integer of 0 to 4. The substituted hydrocarbyl groups are attached to the silicon-oxygen via alkylene or arylene bridging groups, which may be interrupted by oxygen or —NH— groups or terminated by an amino, monoalkyl amino or dialkyl amino where the alkyl group is from 1 to 8. Thus, glycols and glycol monoethers, polyhydric alcohols or polyhydric phenols, can be reacted via alcoholysis with the (RO) group above, typically a lower tetraalkoxysilane (usually a methoxy or ethoxysilane), to form oxygen interrupted substituent groups. Thus for example, tetraethoxysilane can be reacted with glycol monoether residues to replace three ethoxy groups or four ethoxy groups. To replace four ethoxy groups typically a small amount of a catalyst is employed, such as sodium to form a alkali metal alkoxide. Particularly preferred tetraalkyoxysilanes prepared from glycol monoethers are represented by the formula $Si(OCH_2CH_2OR_a)_4$ where $R_a$ is alkyl, cycloalkyl or aryl. Similarly, alcoholysis of the tetralkoxysilane can be conducted with amino alcohols to form aminoalkoxysilanes. Particularly preferred glycol monoethers are selected from $HO—(CH_2CH_2)_mR_{20}$ where m is from 1 to 10 and $R_{20}$ is $C_{1-6}$ alkyl. Particularly preferred amino alcohols are selected from $HO—(CH_2CH_2)_mN(R_{21})_2$ where $R_{21}$ is independently hydrogen or $C_{1-6}$ alkyl, preferably monoalkyl or dialkyl and more preferably dialkyl. Hydrolysis products of formula I can be formed via the hydrolysis and condensation of the compounds of formula I and for example R above may be represented by $—Si(OR)_3$ groups thus forming one or more siloxane bonds.

Examples of tetra-functional silanes represented by the formula I are hydrolyzable silane compounds selected from the group consisting of tetramethoxysilane, tetraethoxysilane, tetrapropoxysilane, tetraisopropoxysilane, tetrabutoxysilane, tetraisobutoxysilane, tetrakis(methoxyethoxy)silane, tetrakis(methoxypropoxy)silane, tetrakis (ethoxyethoxy)silane, tetrakis(methoxyethoxyethoxy)silane, trimethoxyethoxysilane, dimethoxydiethoxysilane, triethoxymethoxysilane, tetra-(4-methyl 2-pentoxy)silane, and tetra-(2-ethylhexoxy)silane.

Hydrolysis products may be represented by poly-(dimethoxysiloxane), poly(diethoxysiloxane), poly (dimethoxy-diethoxysiloxane), tetrakis(trimethoxysiloxy)silane, tetrakis-(triethoxysiloxy)silane, and the like. In addition, examples of tetrafunctional silanes with acyloxy groups are tetracetoxyoxysilane, silicon tetrapropionate and silicon tetrabutyrate.

The method and products prepared thereby of the present invention may employ a composition which further includes from about 0.1 to about 50 wt. %, based on the total weight of the lubricating composition of a compound of formula II below, or a mixture of hydrolysis products and partial condensates of one or more silane additives of formula II (i.e., trifunctional silanes, difunctional silanes, monofunctional silanes, and mixtures thereof) in addition to the tetrafunctional silanes of formula I. The selection of the additional silane additives incorporated into the lubricating compositions of the present invention will depend upon the particular properties to be enhanced or imparted to either the lubricating composition or the formed film coating. The optional silane additives are represented by the formula II $$(R_{10})_nSi(OR_{11})_{4-n} \quad (II)$$

where n is a 1, 2 or 3; the $—OR_{11}$ moiety is a hydrolyzable group and may the same or different when n=1 or 2. Examples of hydrolyzable $—OR_{11}$ groups are for example, alkoxy (preferably $C_{1-6}$-alkoxy, such as, for example, methoxy, ethoxy, n-propoxy, i-propoxy and butoxy), aryloxy (preferably $C_{6-10}$-aryloxy, such as, for example, phenoxy), and acyloxy (for example $C_{1-6}$-acyloxy, such as, for example, acetoxy or propionyloxy).

$R_{10}$ is a non-hydrolyzable group which may optionally carry a functional group.

Examples of $R_{10}$ are alkyl (preferably $C_{1-6}$-alkyl, such as methyl, ethyl, n-propyl, isopropyl, n-butyl, s-butyl and t-butyl, pentyl, hexyl or cyclohexyl), and aryl (preferably $C_{6-10}$-aryl, such as, for example, phenyl and naphthyl).

Specific examples of functional groups of the radical $R_{10}$ are the hydroxyl, ether, amino, monoalkylamino, dialkylamino, amide, carboxyl, mercapto, thioether, acryloxy, cyano, aldehyde, alkylcarbonyl, sulfonic acid and phosphoric acid groups. These functional groups are bonded to the silicon atom via alkylene, or arylene bridging groups, which may be interrupted by oxygen or sulfur atoms or —NH— groups. The said bridging groups are derived, for example, from the above-mentioned alkyl, or aryl radicals. The radicals $R_{10}$ preferably contain from 1 to 18, in particular from 1 to 8, carbon atoms.

Examples of silane additives represented by the above-defined formula are methyltrimethoxysilane, ethyltrimethoxysilane, propyltrimethoxysilane, butyltrimethoxysilane, isobutyltrimethoxysilane, hexyltrimethoxysilane, 4-methyl-2-pentyltriethoxysilane, octyltrimethoxysilane, decyltrimethoxysilane, cyclohexyltrimethoxysilane, cyclohexylmethyltrimethoxysilane, dimethyldimethoxysilane, 2-(3-cyclohexenyl)ethyltrimethoxysilane, 3-cyanopropyltrimethoxysilane, 3-cyanopropyltrimethoxysilane, 4-methyl-2-pentyltrimethoxysilane, phenethyltrimethoxysilane, 3-mercaptopropyltrimethoxysilane, 3-aminopropyltrimethoxysilane, phenyltrimethoxysilane, 3-isocyanopropyltrimethoxysilane, N-(2-amino ethyl)-3-aminopropyltrimethoxysilane, 4-(2-aminoethylaminomethyl)phenethyltrimethoxysilane, phenyltriethoxysilane, ethyltriethoxysilane, propyltriethoxysilane, butyltriethoxysilane, isobutyltriethoxysilane, hexyltriethoxysilane, octyltriethoxysilane, decyltriethoxysilane, cyclohexyltriethoxysilane, cyclohexylmethyltriethoxysilane, 3-cyanopropyltriethoxysilane, 3-ethoxypropyltrimethoxysilane, 2-ethylhexyltrimethoxysilane, 2-ethylhexyltriethoxysilane, 3-ethoxypropyltrimethoxysilane, 3-propoxypropyltrimethoxysilane, 3-methoxyethyltrimethoxysilane, 3-ethoxyethyltrimethoxysilane, 3-propoxyethyltrimethoxysilane, 2-[methoxy(polyethyleneoxy)propyl]heptamethyltrisiloxane, [methoxy(polyethyleneoxy)propyl]trimethoxysilane, [methoxy(polyethylene-oxy)ethyl] trimethoxysilane, [methoxy(polyethyleneoxy)propyl]-triethoxysilane, [methoxy(polyethyleneoxy)ethyl] triethoxysilane, and the like.

Although a condensation catalyst is not an essential ingredient of the lubricating compositions of the present invention or essential to methods herein, the addition of a condensation catalyst can affect film formation, abrasion resistance and other properties of the coating including stability, porosity, caustic resistance, water resistance and the like. When employing a condensation catalyst, the amount of catalyst used can vary widely, but will generally be present in an amount from about 0.005 to about 1 wt. %, based on the total solids of the composition.

Examples of catalysts which can be incorporated into lubricating compositions of the present invention or more preferably are provided when such lubricating compositions are employed in their intended use, for example as lubricants for engines, gears, hydraulic fluids, etc; are (i) metal acetylacetonates, (ii) diamides, (iii) imidazoles, (iv) amines and ammonium salts, (v) inorganic acids, organic acids, organic sulfonic acids, and their amine salts, (vi) alkali metal salts of carboxylic acids, (vii) alkali and alkaline earth metal hydroxides and oxides, (viii) fluoride salts, and (ix) organometallic. Thus, examples of such catalysts include for group (i) such compounds as aluminum, zinc, iron and cobalt acetylacetonates; group (ii) dicyandiamide; for group (iii) such compounds as 2-methylimidazole, 2-ethyl-4 methylimidazole and 1-cyanoethyl-2-propylimidazole; for group (iv), such compounds as benzyldimethylamine, and 1,2-diaminocyclohexane; for group (v), such compounds hydrochloric acid, sulfuric acid, nitric acid, acetic acid, trifluoromethanesulfonic acid; for group (vi), such compounds as sodium acetate, for group (vii), such compounds as sodium hydroxide, and potassium hydroxide, for group (viii), tetra n-butyl ammonium fluoride, and for group (ix), dibutyltin dilaurate and tin di(2-ethylhexonate), and the like.

In a further aspect, the present invention provides a composition derivable from a partial condensation of the above defined composition. By "partial condensation" and "partial condensate" in connection with the present invention is meant that some of the hydrolyzable groups in the mixture have reacted while leaving a substantial amount of hydrolyzable groups available for a condensation reaction. Typically, a partial condensate means that at least 20%, preferably at least 30%, more preferably at least 50% of the hydrolyzable groups are still available for condensation reaction.

In another aspect, the present invention provides a composition derivable from a complete condensation of the above defined composition. By "complete condensation" in connection with the present invention is meant that most or all of the hydrolyzable groups in the mixture have reacted. Typically, a complete condensate means that little or no hydrolyzable groups remain available for condensation reaction.

In another aspect, the present invention provides a process for preparing a partial or complete condensate containing the above defined composition by reacting the components of the composition in an organic solvent in the presence of water and a catalyst, such as an acid or a base.

In a still further aspect, the present invention also provides a method for treating a substrate, comprising the step of applying to at least a portion of the surface of the substrate the compositions as defined above. Preferably, the obtained coating on the substrate is cured, generally at a temperature of about 20 to 300° C. depending on if and the type of catalyst chosen. The substrate may be pre-heated as to cause curing of the composition when applied, or alternatively the heating may take place simultaneously with or subsequent to the application of the composition onto the substrate.

Lubricating Oils and Lubricating Compostions

The lubricating oil compositions of the present invention can be conveniently prepared by simply blending or mixing the hydrolyzable tetra-functional silane of the present invention optionally with other additives, with an oil of lubricating viscosity (base oil). The compounds of the invention may also be pre-blended as a concentrate or package with various other additives in the appropriate ratios to facilitate blending of a lubricating composition containing the desired concentration of additives. The compounds of the present invention are blended with base oil using a concentration at which they provide improved antiwear effect and are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C.-25° C.) can be measured by either actual precipitation from the oil composition or the formulation of a "cloudy" solution which evidences formation of insoluble wax particles.

The lubricating oil, or base oil, used in the lubricating oil compositions of the present invention are generally tailored to the specific use, e.g., engine oil, gear oil, industrial oil, cutting oil, etc. For example, where desired as a crankcase engine oil, the base oil typically will be a mineral oil or synthetic oil of viscosity suitable for use in the crankcase of an internal combustion engine such as gasoline engines and diesel engines which include marine engines. Crankcase lubricating oils ordinarily have a viscosity of about 1300 cSt at 0° F. to 24 cSt at 210° F. (99° C.). The lubricating oils may be derived from synthetic or natural sources. Natural oils include animal oils and vegetable oils (e.g., castor oil, lard oil) as well as mineral oil. Mineral oil for use as the base oil in this invention includes paraffinic, naphthenic and other oils that are ordinarily used in lubricating oil compositions, including solvent treated, hydro treated or oils from Fisher-Tropsch processes. Preferred oils of lubricating viscosity used in this invention should have a viscosity index of at least 95, preferably at least 100. The preferred are selected from API Category oils Group I through Group IV and preferably from Group II, III and IV or mixtures thereof optionally blended with Group I. Synthetic oils include both hydrocarbon synthetic oils and synthetic esters. Useful synthetic hydrocarbon oils include liquid polymers of alpha olefins having the proper viscosity. Especially useful are the hydrogenerated liquid oligomers of $C_6$ to $C_{12}$ alpha olefins such as 1-decene trimer. Likewise, alkyl benzenes of proper viscosity such as didodecyl benzene can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used. Blends of various mineral oils, synthetic oils and minerals and synthetic oils may also be advantageous, for example to provide a given viscosity or viscosity range. In general the base oils or base oil mixtures for engine oil are preselected so that the final lubricating oil, containing the various additives, including the present fuel economy additive composition, has a viscosity at 100° C. of 4 to 22° C., preferably 10 to 17 centistokes and more preferably 13 to 17° C.

Typically the lubricating oil composition will contain a variety of compatible additives desired to impart various properties to the finished lubricating oil composition depending on the particular end use and base oils used. Such additives include supplemental neutral and basic detergents such as natural and overbased organic sulfonates and normal and overbased phenates and salicylates, dispersants, and/or ashless dispersants.

Also included are other additives such as antiwear agents, friction modifiers, rust inhibitors, foam inhibitors, pour point dispersants, antioxidants, including the so called viscosity index (VI) improvers, dispersant VI improvers and, as noted above, other corrosion or wear inhibitors.

The Detergent

Metal detergents have widely been employed in engine oil lubricating formulations to neutralize the acidic by-products of the combustion process and/or lubricant oxidation and to provide a soap effect and keep pistons and other high temperature surfaces clean thus preventing sludge. A number of different surfactant types have been used to produce different lubricant detergents. Common examples of metal detergents included: sulphonates, alkylphenates, sulfurized alkyl phenates, carboxylates, salicylates, phosphonates, and phosphinates. Commercial products are generally referred to as neutral or overbased. Overbased metal detergents are generally produced by carbonating a mixture of hydrocarbons, detergent acid, for example: sulfonic acid, alkylphenol, carboxylate etc., metal oxide or hydroxides (for example calcium oxide or calcium hydroxide) and promoters such as xylene, methanol and water. For example for preparing an overbased calcium sulfonate; in carbonation, the calcium oxide or hydroxide reacts with the gaseous carbon dioxide to form calcium carbonate. The sulfonic acid is neutralized with an excess of CaO or Ca(OH), to form the sulfonate.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

The Dispersant

The dispersant employed in the compositions of this invention can be ashless dispersants such as an alkenyl succinimide, an alkenyl succinic anhydride, an alkenyl succinate ester, and the like, or mixtures of such dispersants.

Ashless dispersants are broadly divided into several groups. One such group is directed to copolymers which contain a carboxylate ester with one or more additional polar function, including amine, amide, imine, imide, hydroxyl carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethyl methacrylate copolymers and the like. Additionally, high molecular weight amides and polyamides or esters and polyesters such as tetraethylene pentamine, polyvinyl polysterarates and other polystearamides may be employed. Preferred dispersants are N-substituted long chain alkenyl succinimides.

Mono and bis alkenyl succinimides are usually derived from the reaction of alkenyl succinic acid or anhydride and alkylene polyamines. These compounds are generally considered to have the formula

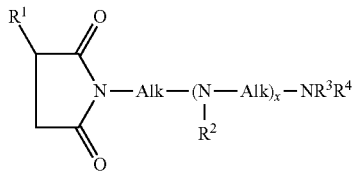

wherein $R^1$ is a substantially hydrocarbon radical having a molecular weight from about 450 to 3000, that is, $R^1$ is a hydrocarbyl radical, preferably an alkenyl radical, containing about 30 to about 200 carbon atoms; Alk is an alkylene radical of 2 to 10, preferably 2 to 6, carbon atoms, $R^2$, $R^3$, and $R^4$ are selected from a $C_1$-$C_4$ alkyl or alkoxy or hydrogen, preferably hydrogen, and x is an integer from 0 to 10, preferably 0 to 3. The actual reaction product of alkylene or alkenylene succinic acid or anhydride and alkylene polyamine will comprise the mixture of compounds including succinamic acids and succinimides. However, it is customary to designate this reaction product as a succinimide of the described formula, since this will be a principal component of the mixture. The mono alkenyl succinimide and bis alkenyl succinimide produced may depend on the charge mole ratio of polyamine to succinic groups and the particular polyamine used. Charge mole ratios of polyamine to succinic groups of about 1:1 may produce predominately mono alkenyl succinimide. Charge mole ratios of polyamine to succinic group of about 1:2 may produce predominantly bis alkenyl succinimide.

These N-substituted alkenyl succinimides can be prepared by reacting maleic anhydride with an olefinic hydrocarbon followed by reacting the resulting alkenyl succinic anhydride with the alkylene polyamine. The $R^1$ radical of the above formula, that is, the alkenyl radical, is preferably derived from a polymer prepared from an olefin monomer containing from 2 to 5 carbon atoms. Thus, the alkenyl radical is obtained by polymerizing an olefin containing from 2 to 5 carbon atoms to form a hydrocarbon having a molecular weight ranging from about 450 to 3000. Such olefin monomers are exemplified by ethylene, propylene, 1-butene, 2-butene, isobutene, and mixtures thereof.

In a preferred aspect, the alkenyl succinimide may be prepared by reacting a polyalkylene succinic anhydride with an alkylene polyamine. The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. 0 355 895; terpolymer PIBSA described in U.S. Pat. No. 5,792,729; sulfonic acid PIBSA described in U.S. Pat. No. 5,777,025 and European Patent Application Publication No. 0 542 380; and purified PIBSA described in U.S. Pat. No. 5,523,417 and European Patent Application Publication No. 0 602 863. The disclosures of each of these documents are incorporated herein by reference in their entirety. The polyalkylene succinic anhydride is preferably a polyisobutenyl succinic anhydride. In one preferred embodiment, the polyalkylene succinic anhydride is a polyisobutenyl succinic anhydride having a number average molecular weight of at least 450, more preferably at least 900 to about 3000 and still more preferably from at least about 900 to about 2300.

In another preferred embodiment, a mixture of polyalkylene succinic anhydrides are employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 450 to below 1000 and the high molecular weight component has a number average molecular weight of from 1000 to about 3000. Still more preferably, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

The polyalkylene succinic anhydride can also be incorporated with the detergent which is anticipated to improve stability and compatibility of the detergent mixture. When employed with the detergent it can comprise from 0.5 to 5 percent by weight of the detergent mixture and preferably from about 1.5 to 4 weight percent.

The preferred polyalkylene amines used to prepare the succinimides are of the formula:

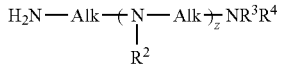

wherein z is an integer of from 0 to 10 and Alk, $R^2$, $R^3$, and $R^4$ are as defined above. The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl)imidazoline, 1-(2-aminopropyl)-piperazine, 1,4-bis(2-aminoethyl) piperazine and 2-methyl-1-(2-aminobutyl)piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898-905 (Interscience Publishers, New York, 1950). The term "ethylene amine" is used in a generic sense to denote a class of polyamines conforming for the most part to the structure $$H_2N(CH_2CH_2NH)_aH$$

wherein a is an integer from 1 to 10.

Thus, it includes, for example, ethylene diamine, diethylene triamine, triethylene tetraamine, tetraethylene pentamine, pentaethylene hexamine, and the like. The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Also included within the term "alkenyl succinimides" are post-treated succinimides such as post-treatment processes involving borate or ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety. Preferably, the carbonate-treated alkenyl succinimide is a polybutene succinimide derived from polybutenes having a molecular weight of 450 to 3000, preferably from 900 to 2500, more preferably from 1300 to 2300, and preferably from 2000 to 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912 incorporated herein by reference.

Preferably, the alkenyl succinimide component comprises from 1 to 20 weight percent, preferably 2 to 12 weight percent, and more preferably 4 to 8 weight percent of the weight of the lubricant composition.

Preferably a minor amount of antiwear agent, a metal dihydrocarbyl dithiophosphate is added to the lubricant composition. The metal is preferably zinc. The dihydrocarbyldithiophosphate may be present in amount of 0.1 to 2.0 mass percent but typically low phosphorus compositions are desired so the dihydrocarbyldithiophosphate is employed at 0.25 to 1.2, preferably 0.5 to 0.7, mass %, in the lubricating oil composition. Preferably, zinc dialkylthiophosphate (ZDDP) is used. This provides antioxidant and antiwear properties to the lubricating composition. Such compounds may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol(4-methyl-1-pentane-2-ol), 1-pentanol, 2-methyl butanol, and 2-methyl-1-propanol. The hydrocarbyl groups can be a primary, secondary, or mixtures thereof, e.g., the compounds may contains primary and/or secondary alkyl groups derived from primary or secondary carbon atoms. Moreover, when employed, there is preferably at least 50, more preferably 75 or more, most preferably 85 to 100, mass % secondary alkyl groups; an example is a ZDDP having 85 mass % secondary alkyl groups and 15 mass % primary alkyl groups, such as a ZDDP made from 85 mass % butan-2-ol and 15 mass % iso-octanol. Even more preferred is a ZDDP derived from derived from sec-butanol and methylisobutylcarbinol and most preferably wherein the sec-butanol is 75 mole percent.

The metal dihydrocarbyldithiophosphate provides most if not all, of the phosphorus content of the lubricating oil composition. Amounts are present in the lubricating oil composition to provide a phosphorus content, expressed as mass % elemental phosphorus, of 0.10 or less, preferably 0.08 or less, and more preferably 0.075 or less, such as in the range of 0.025 to 0.07. In a particularly preferred aspect, the lubricating oil composition does not contain a metal dihydrocarbyldithiophosphate and another aspect of this lubricating oil composition contains essentially no added phosphorus additive component.

Oxidation inhibitors or antioxidants reduce the tendency of base stocks to deteriorate in service, which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl-substituted diphenylamine, alkyl-substituted phenyl and naphthylamines, phosphorus esters, metal thiocarbamates, ashless thiocarbamates (preferred are dithiocarbamates are methylenebis(dibutyldithiocarbamate), ethylenebis(dibutyldithiocarbamate), and isobutyl disulfide-2,2'-bis(dibutyldithiocarbamate). Preferred phenol type oxidation inhibitors are selected from the group consisting of: 4,4'-methylene bis(2,6-di-tert-butylphenol), 4,4'-bis(2,6-di-tert-butylphenol), 4,4'-bis(2-methyl-6-tert-butylphenol), 2,2'-methylene bis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methyl-phenol, 2,6-di-tert-butyl-4-ethylphenol, 2,4-dimethyl-6-tert-butyl-phenol, 2,6-di-tert-4-(N,N'dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine type oxidation inhibitor: alkylated diphenylamine, octylated/butylated diphenylamine and a hindered phenolic antioxidant primarily 3,5-di-tert-butyl-4-hydroxycinnamic acid $C_{7-9}$ branched alkyl ester, phenyl-α-naphthylamine, and alkylated-α-naphthylamine.

In some instances a friction modifier is needed. Such friction modifier is preferably an oil soluble organic friction modifier incorporated in the lubricating oil composition in an amount of from about 0.02 to 2.0 wt. % of the lubricating oil composition. Preferably, from 0.05 to 1.0, more preferably from 0.1 to 0.5 wt. % of the friction modifier is used. Friction modifiers include such compounds as aliphatic amines or ethoxylated aliphatic amines, aliphatic fatty acid amides, aliphatic carboxylic acids, aliphatic carboxylic esters of polyols such as glycerol esters of fatty acid as exemplified by glycerol oleate, boric esters of glycerol fatty acid monoesters, aliphatic carboxylic ester-amides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Representative examples of suitable friction modifiers are found in U.S. Pat. No. 3,933,659 which discloses fatty acid esters and amides; U.S. Pat. No. 4,105,571 which discloses glycerol esters of dimerized fatty acids; U.S. Pat. No. 4,702,859 which discloses esters of carboxylic acids and anhydrides with alkanols; U.S. Pat. No. 4,530,771 which is a preferred borated glycerol monooleate comprising esters constituted with a glycerol, fatty acid and a boric acid, said ester having a positive amount up to 2.0 moles of a carboxylic acid residue comprising a saturated or unsaturated alkyl group having 8 to 24 carbon atoms and 1.5 to 2.0 moles of a glycerol residue, both per unit mole of a boric acid residue on average of the boric esters used singly or in combination, molar proportion between said carboxylic acid residue and said glycerol residue being that the glycerol residue is 1.2 moles or more based on 1 mole of the carboxylic acid residue; U.S. Pat. No. 3,779,928 which discloses alkane phosphonic acid salts; U.S. Pat. No. 3,778,375 which discloses reaction products of a phosphonate with an oleamide; and U.S. Pat. No. 3,932,290 which discloses reaction products of di-(lower alkyl) phosphites and epoxides. The disclosures of the above references are herein incorporated by reference. Examples of nitrogen containing friction modifiers, include, but are not limited to, imidazolines, amides, amines, alkoxylated amines, alkoxylated ether amines, amine oxides, amidoamines, nitriles, betaines, quaternary amines, imines, amine salts, amino guanadine, alkanolamides, and the like. Such friction modifiers can contain hydrocarbyl groups that can be selected from straight chain, branched chain or aromatic hydrocarbyl groups or admixtures thereof, and may be saturated or unsaturated. Hydrocarbyl groups are predominantly composed of carbon and hydrogen but may contain one or more hetero atoms such as sulfur or oxygen. Preferred hydrocarbyl groups range from 12 to 25 carbon atoms and may be saturated or unsaturated. More preferred are those with linear hydrocarbyl groups.

The lubricating composition of the present invention may also contain a viscosity index improver or VII. Viscosity Index Improver. Examples of the viscosity index improvers are poly-(alkyl methacrylate), ethylene-propylene copolymer, styrene-butadiene copolymer, and polyisoprene. Viscosity index improvers of dispersant type (having increased dispersancy) or multifunction type are also employed. These viscosity index improvers can be used singly or in combination. The amount of viscosity index improver to be incorporated into an engine oil varies with desired viscosity of the compounded engine oil, and generally in the range of 0.5-20 wt. % per total amount of the engine oil.

EXAMPLES

The invention will be further by the following examples, which set forth particularly advantageous embodiments. While the examples are provided to illustrate the present invention, they are not intended to limit it.

Example 1-8

The lubricating oil compositions of the present invention (Example 1-8 and Comparative Examples A, B, and C) were prepared according to the weight percentages shown in Table 1. The baseline oil composition depicted as Comparative Example A, was prepared as a baseline oil typical for a generic low emission diesel lubricant. Several blends of the baseline oil prepared for Examples 1-8. The baseline oil comprised approximately 75 wt. % of an oil of lubricating viscosity, namely a 2:1 mixture of neutral oils –100N and 220 N base oils, a succinimide dispersant mixture of approximately 4.75 wt. % of or a bis-succinimide prepared from a 2300 avg molecular weight polyisobutylene succinic anhydride with a heavy polyamine, 2.5 wt. % of a borated bis-succinimide prepared from a 1300 avg molecular weight polyisobutylene succinic anhydride with a heavy polyamine, approximately 4.5 wt. % of a 140BN salicylate detergent prepared mixture of $C_{18-30}$ alpha olefins and $C_{10-15}$ branched olefins (prepared for example as disclosed in U.S. Patent Publication No. US 2004/0235686 disclosed herein by reference in its entirety); and approximately 0.6 wt. % of a 16 BN calcium synthetic alkylarylsulfonate prepared from a mixture of $C_{20-40}$ alpha olefins and $C_{10-15}$ branched olefins, approximately 1 wt. % of an equal part mixture of antioxidants comprising a mixture of an octylated/butylated diphenylamine and a hindered phenolic antioxidant primarily 3,5-di-tert-butyl-4-hydroxycinnamic acid $C_{7-9}$ branched alkyl ester, approximately 0.7 wt. % of a secondary ZDDP derived from derived from sec-butanol and methylisobutylcarbinol, an ethylene-propylene copolymer and foam inhibitor. The baseline oil was a 10W-40 blended oil made from Group II oils. To a baseline oil was added the silane additives of the present invention. The baseline oil consists of diluent oil, dispersant, detergent, oxidation inhibitor, foam inhibitor, viscosity index improver, and mineral base oil.

Comparative examples were also prepared. Comparative Example A as stated above, contains the baseline oil. Comparative Example B was prepared with baseline oil and a top-treat of approximately 0.7 wt. % of the same ZDDP used in the baseline. A third comparative example, Comparative Example C, was prepared with the baseline oil and a top-treat of approximately 1 wt. % of an Octyltriethoxysilane. Comparative Example D was commercial available CI-4 fully-formulated engine oil.

TABLE 1

| Composition of Oil Samples Tested | | | | | | | | | | | |
|---|---|---|---|---|---|---|---|---|---|---|---|
| | Comparative Examples | | | Examples | | | | | | | |
| Components | A Wt. % | B Wt. % | C Wt. % | 1 Wt. % | 2 Wt. % | 3 Wt. % | 4 Wt. % | 5 Wt. % | 6 Wt. % | 7 Wt. % | 8 Wt. % |
| Tetraethoxysilane | | | | 2 | 1.6 | 1 | | | | | 1 |
| Tetrabutoxysilane | | | | | | | 2 | 2.6 | 3 | | |
| Tetrapropyoxysilane | | | | | | | | | | 1.9 | |

TABLE 1-continued

| Composition of Oil Samples Tested | | | | | | | | | | | |
|---|---|---|---|---|---|---|---|---|---|---|---|
| | Comparative Examples | | | Examples | | | | | | | |
| Components | A Wt. % | B Wt. % | C Wt. % | 1 Wt. % | 2 Wt. % | 3 Wt. % | 4 Wt. % | 5 Wt. % | 6 Wt. % | 7 Wt. % | 8 Wt. % |
| Aminopropyltriethoxy silane | | | | | | | | | | | 0.533 |
| ZnDTP (secondary alkyl) | | 0.7 | | | | | | | | | |
| Octyltriethoxysilane | | | 1 | | | | | | | | |
| Baseline Oil | 100 | 99.3 | 99 | 98.04 | 98.43 | 99.01 | 98.04 | 97.47 | 97.09 | 98.14 | 98.47 |
| Total | 100 | 100 | 100 | 100 | 100 | 100 | 100 | 100 | 100 | 100 | 100 |

Performance Testing

Three different bench wear tests were conducted to examine wear performance. They are the Electrical Contact Resistance (ECR) bench test, the High Frequency Reciprocating Rig (HFRR) bench test, and the Mini-Traction Machine (MTM) bench test. The last two instruments are sold by PCS Instruments Ltd., London, UK.

For the ECR bench test, the relevant conditions are shown below in Table 2.

TABLE 2

| Tribometer Test Conditions and Tribocouple Material | | |
|---|---|---|
| | Material 52100 Steel | |
| | Slider (0.635 cm Diameter Ball) | Flat Disk |
| Hardness | Rc = 62 | Rc = 58 |
| Surface Roughness, Ra μm | 0.02 | 0.046-0.056 |
| Load, N | 4.90 | |
| Initial Contact Pressure, GPa | 0.71 | |
| Initial Contact Area, $cm^2$ | $6.9 \times 10^{-5}$ | |
| Sliding Speed, cm/Sec. | 17.3 | |
| Temperature, ° C. | 100 | |
| Run Time, Sec. | 1200 | |
| Atmosphere | Laboratory Air | |

Simultaneous measurements of ECR and the coefficient of friction for each blend were made using a ball-on-disk tribometer. Test conditions and materials are summarized in Table 3. Both the disk and the slider were of 52100 steel, the disk hardness being $R_c$=58 and the slider hardness being $R_c$=62. Before each run, the disk was polished with a succession of grades of silicon carbide abrasive papers and cloths to a final average surface roughness of 0.046-0.056 μm (~1.8-2.2 μin.) as measured with a Model 5P Tallysurf. The sliders were purchased 0.635 cm (¼-in.) diameter ball bearings, Grade 5. For Grade 5 bearings, the industry average surface roughness specification is 0.02 μm (0.8 μin.). After ultrasonic cleaning in reagent-grade hexane and reagent-grade acetone and thorough air drying, the balls were used as sliders. No surface topography characterization other than average surface roughness was carried out for the disks. For the sliders, the average surface roughness specified by the Grade 5 classification was assumed to apply and no other surface topographical measurement was made.

The disk was clamped in a cup that rotated. A spring-hinged arm held a collect chunk in which the ball was firmly clamped so that it slid and did not rotate. When the ball was lowered onto the disk, the arm was constrained by a strain gauge. Output from the strain gauge was continuously recorded on one channel of a two-pen strip chart recorder. A deadweight was used to calibrate the strain gauge, resulting in the coefficient of friction being directly recorded. ECR was measured using a voltage divider circuit.

Voltages measured by the strip char recorder were reproducible to about ±2%. Obviously, coefficients of friction and ECR voltages, being dependent upon contact conditions, were less reproducible. Past experience with coefficient of friction measurements with this tribometer had shown coefficients of friction in short-term tests, such as those employed in the present work, were reproducible to about 5-12%, depending on the sample. Not surprisingly, resistances, especially those in the megohm range, varied as much as a factor of two, reflecting the nonuniformity of contact conditions.

On completing the run, the collet chuck holding the ball was removed from the tribometer and the war scar on the ball was briefly examined under a 100 power microscope. Marks were then made on a ball near the wear scar with a marking pen to facilitate finding the scar. The collet chuck was loosened, thus freeing the ball, which was mounted for photomicrography at 100× magnification. Wear scar diameters (WSD) were measured on the 100× photomicrographs. Two perpendicular diameters were measured: wear scars were either circular or elliptical. In the case of elliptical wear scars, major and minor diameters were measured, and the diameter of a circle of equal area calculated. Diameters (or equivalent diameters) of at least two wear scars were averaged to obtain an average wear scar diameter for each oil tested.

For the HFRR bench test the relevant conditions are shown below in Table 3.

TABLE 3

| HFRR Bench Test Conditions | |
|---|---|
| Load | 9.806 N, 1 Kgf |
| Initial Contact Pressure | 1.41 GPa |
| Temperature | 116° C. |
| Tribocouple | 52100/52100 |
| Frequency | 20 Hz |
| Stroke Length | 1 mm |
| Length of Time | 20 Min. Test |
| Engine Soot | 6% |

For the HFRR bench test, conditions are more severe than the ECR test to mimic valve train conditions which in diesel engines may reach 250,000-300,000 psi (maximum) [Mc Geehan, J. A., and Ryason, P. R., "Preventing Catastrophic Camshaft Lobe Failure in Low Emission Diesel Engines,"

2000, SAE Paper 200-01-2949]. There is both startup and complete stop as the ball makes its stroke from start to finish. Again, wear scar diameters are measured.

The PCS MTM instrument was modified so that a ¼-in. diameter Falex 52100 steel test ball (with special holder) was substituted for the pin holder that came with the instrument [Yamaguchi, E. S., "Friction and Wear Measurements Using a Modified MTM Tribometer," IP.com Journal 7, Vol. 2, 9, pp 57-58 (August 2002), No. IPCOM000009117D]. The instrument was used in the pin-on-disk mode and run under sliding conditions. It is achieved by fixing the ball rigidly in the special holder, such that the ball has only one degree of freedom, to slide on the disk. The conditions are shown in Table 4.

TABLE 4

| Test Conditions for MTM | | |
|---|---|---|
| Load | 14 N | |
| Initial Contact Pressure | 1.53 GPa | |
| Temperature | 100° C. | |
| Tribocouple | 52100/52100 | |
| Speed | mm/Sec. | Min. |
| | 3800 | 10 |
| | 2000 | 10 |
| | 1000 | 10 |
| | 100 | 10 |
| | 20 | 10 |
| | 10 | 10 |
| | 5 | 10 |
| Length of Time | 70 Min. Test | |
| Diesel Engine Soot | 9% | |

Engine soot obtained from the overhead recovery system of a engine testing facility was used for this test. The soot was made into a slurry with pentane, filtered through a sintered glass funnel, dried in a vacuum oven under an $N_2$ atmosphere and ground to 50 mesh (300 μm) maximum before use. The objective of this action was to make reproducible particles that would give rise to abrasive wear as seen in modern EGR engines.

To prepare the test specimens, the anti-corrosion coating of the PCS Instruments 52100 smooth (0.02 micron $R_a$), steel discs was removed using heptane, hexane, and isooctane. Then, the discs were wiped clean with a soft tissue and submersed in a beaker of the cleaning solvent until the film on the disc track had been removed, and the track of the disc appeared shiny. The discs and test balls were placed in individual containers and submerged in Chevron 450 thinner. Lastly, the test specimens were ultrasonically cleaned by placing them in a sonicator for 20 minutes.

Wear results from the three bench tests are presented in Table 5 below. Lower values indicate less wear.

TABLE 5

| Bench Test Results | | | | |
|---|---|---|---|---|
| | Wear Scar Diameters | | | Effectiveness of Film |
| Sample Oil Tested | ECR[a], μm | HFRR[b], μm | MTM[c], μm | Insulation By ECR[d] (Relative), E04 mV |
| EXAMPLES | | | | |
| 1 | 140 | 150 | 424 | 4.55 |
| 2 | 120 | 143 | 407 | 4.62 |
| 3 | 140 | 159 | 433 | 4.57 |

TABLE 5-continued

| Bench Test Results | | | | |
|---|---|---|---|---|
| | Wear Scar Diameters | | | Effectiveness of Film |
| Sample Oil Tested | ECR[a], μm | HFRR[b], μm | MTM[c], μm | Insulation By ECR[d] (Relative), E04 mV |
| 4 | 120 | 159 | 460 | 4.58 |
| 5 | 120 | 144 | 455 | 4.54 |
| 6 | 120 | 156 | 403 | 4.49 |
| 7 | 170 | 158 | 451 | 4.12 |
| 8 | 100 | 161 | 470 | 4.53 |
| COMPARATIVE EXAMPLES | | | | |
| A | 130 | 235 | 634 | 2.59 |
| B | 150 | 178 | 558 | 4.13 |
| C | 100 | 151 | 510 | 4.37 |
| D | 150 | 97 | 408 | 3.39 |

[a]ECR Electrical Contact Resistance
[b]HFRR High Frequency Reciprocal Rig
[c]MTM Mini Traction Machine
[d]ECR area measured as the sum of 2000 measurements of the voltage across the contacting surface From the overall results shown in Table 5, the wear performance of the silane-containing blends representing the present invention shows improvement relative to Comparative Example B, prepared with baseline oil and 0.7 wt. % of ZDDP. In fact, Example 2 shows equivalent or better performance in the three out of four areas compared to a commercial CI-4 fully-formulated engine oil. In particular, the ECR result, the MTM result, and the relative film insulation of Example 2 exceeded that of Comparative Example D, a premium product. ECR films show the result of film formation minus film removal processes. The larger the number, the greater film formation dominates relative to the film removal processes. In this comparison, Example 2 shows greater film formation processes than Comparative Example D, suggesting that the insulating film of Example 2 is extremely robust and can be sustained throughout the 20-minute test.

Comparative Example C (octyl triethoxy silane), although giving excellent wear scar diameter in the ECR test, was much less effective than Example 2 in the more demanding HFRR and MTM bench tests, as well as the film insulation measurements.

What is claimed is:

1. A method for forming an antiwear film on an internal engine component comprising: contacting a surface of an internal wearing component of the engine with a tetra-functional hydrolyzable silane compound selected from the group consisting of tetramethoxysilane, tetraethoxysilane, tetrapropoxysilane, tetraisopropoxysilane, tetrabutoxysilane, tetraisobutoxysilane, tetrakis(methoxyethoxy)silane, tetrakis (methoxypropoxy)silane, tetrakis(ethoxyethoxy)silane, tetrakis(methoxyethoxyethoxy)silane, trimethoxyethoxysilane, dimethoxydiethoxysilane, triethoxymethoxysilane, tetra-(4-methyl 2 pentoxy)silane and tetra-(2-ethylhexoxy) silane; and hydrolyzing and condensing the tetra-functional silane to thereby form a film.

2. The method according to claim 1, further comprising heating the internal wearing component of the engine to a temperature of about 20 to 300° C.

3. The method according to claim 2, wherein at least one contacting, hydrolyzing and condensing, or heating steps are conducted by operating said engine.

4. The method according to claim 1, wherein the hydrolyzing and condensing step is conducted in the presence of a catalyst.

5. The method according to claim 4, wherein the catalyst is selected from the group consisting of (i) metal acetylacetonates, (ii) diamides, (iii) imidazoles, (iv) amines and ammonium salts, (v) inorganic acids, organic acids, organic sulfonic acids, and their amine salts, (vi) alkali metal salts of carboxylic acids, (vii) alkali and alkaline earth metal hydroxides and oxides, (viii) fluoride salts, and (ix) organometallic groups.

6. The method according to claim 1, wherein the tetra-functional hydrolyzable silane compound is in a lubricating oil medium.

7. The method according to claim 6, wherein the lubricating oil further comprises at least one additive selected from the group consisting of detergents, dispersants, and antioxidants.

8. The method according to claim 7, wherein the lubricating oil further comprises water as a contaminant.

9. The method according to claim 1, wherein the tetra-functional hydrolyzable silane compound is tetraethoxysilane.

10. A method for forming an antiwear film on an internal engine component comprising: contacting a surface of an internal wearing component of the engine with a tetra-functional hydrolyzable silane compound of the formula I or a hydrolysis product thereof:

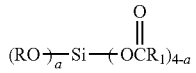

(I)

wherein each R is independently a $C_{1-20}$ hydrocarbyl group selected from the group consisting of straight and branched chain alkyl, cycloalkyl, alkcycloalkyl, aryl, alkaryl, arylalkyl and substituted hydrocarbyl groups having one or more substituents selected from hydroxy, alkoxy, ester or amino groups; each $R_1$ is independently straight and branched chain alkyl, cycloalkyl and aryl; and a is an integer of 0 to 4, wherein at least one R is a substituted hydrocarbyl group.

11. The method according to claim 10, wherein the at least one substituted hydrocarbyl group is derived from a glycol monoether or an amino alcohol.

12. The method according to claim 1, further comprising contacting a surface of an internal wearing component of the engine with a partially non-hydrolyzable silane additive represented by the formula II $$(R_{10})_n Si(OR_{11})_{4-n} \quad (II)$$

wherein: each $OR_{11}$ group is a hydrolyzable moiety independently selected from the group consisting of alkoxy, aryloxy, and acyloxy, each $R_{10}$ is a non-hydrolyzable group independently selected from alkyl, aryl, substituted alkyl, and substituted aryl, wherein the substituent is a functional group selected from hydroxyl, ether, amino, monoalkylamino, dialkylamino, amide, carboxyl, mercapto, thioether, acryloxy, cyano, aldehyde, alkylcarbonyl, sulfonic acid and phosphoric acid; and n is an integer of 1, 2 or 3.

13. The method according to claim 12, wherein the surface of an internal wearing component of the engine is first contacted with the partially non-hydrolyzable silane additives represented by the formula II.

14. The method according to claim 12, wherein the tetra-functional hydrolyzable silane compound and the non-hydrolyzable silane additives are represented by the formula II are mixed in an oil of lubricating viscosity prior to contacting the surface of an internal wearing component of the engine.

15. The method according to claim 12, wherein the $OR_{11}$ group is selected from the group consisting of $C_{1-6}$ alkoxy, $C_{6-10}$ aryloxy, and $C_{1-6}$ acyloxy.

16. The method according to claim 12, wherein the partially non-hydrolyzable silane additive is selected from the group consisting of methyltrimethoxysilane, ethyltrimethoxysilane, propyltrimethoxysilane, butyltrimethoxysilane, isobutyltrimethoxysilane, hexyltrimethoxysilane, 4-methyl-2-pentyltriethoxysilane, octyltrimethoxysilane, decyltrimethoxysilane, cyclohexyltrimethoxysilane, cyclohexylmethyltrimethoxysilane, dimethyldimethoxysilane, 2-(3-cyclohexenyl)ethyltrimethoxysilane, 3-cyanopropyltrimethoxysilane, 3-cyanopropyltrimethoxysilane, 4-methyl-2-pentyltrimethoxysilane, phenethyltrimethoxysilane, 3-mercaptopropyltrimethoxysilane, 3-aminopropyltrimethoxysilane, phenyltrimethoxysilane, 3-isocyanopropyltrimethoxysilane, N-(2-aminoethyl)-3-aminopropyltrimethoxysilane, 4-(2-aminoethylaminomethyl)phenethyltrimethoxysilane, phenyltriethoxysilane, ethyltriethoxysilane, propyltriethoxysilane, butyltriethoxysilane, isobutyltriethoxysilane, hexyltriethoxysilane, octyltriethoxysilane, decyltriethoxysilane, cyclohexyltriethoxysilane, cyclohexylmethyltriethoxysilane, 3-cyanopropyltriethoxysilane, 3-ethoxypropyltrimethoxysilane, 2-ethylhexyltrimethoxysilane, 2-ethylhexyltriethoxysilane, 3-ethoxypropyltrimethoxysilane, 3-propoxypropyltrimethoxysilane, 3-methoxyethyltrimethoxysilane, 3-ethoxyethyltrimethoxysilane and 3-propoxyethyltrimethoxysilane.

17. The method according to claim 12, wherein the partially non-hydrolyzable silane additive is selected from 3-aminopropyltrimethoxysilane, 3-aminoporpyltriethoxysilane, 3-aminopropyltripropoxysilane, 3-aminopropyltributoxysilane, and 4-aminobutyltriethoxysilane.

18. The method according to claim 12, further comprising pre-blending the tetra-functional hydrolyzable silane compound and the partially non-hydrolyzable silane additive into an oil of lubricating viscosity with at least one additive selected from the group consisting of detergents, dispersants, and antioxidants.

19. A product prepared according to the method of claim 1.

20. A product prepared according to the method of claim 6.

21. A product prepared according to the method of claim 7.

22. A product prepared according to the method of claim 14.

23. A product prepared according to the method of claim 18.

* * * * *